US005901893A

United States Patent [19]

Furlani et al.

[11] Patent Number: 5,901,893

[45] Date of Patent: May 11, 1999

[54] APPARATUS AND METHOD FOR CONVEYING A WEB

[75] Inventors: Edward P. Furlani, Lancaster; Syamal K. Ghosh; Dilip K. Chatterjee, both of Rochester, all of N.Y.

[73] Assignee: Eastman Kodak Company, Rochester, N.Y.

[21] Appl. No.: 08/975,996

[22] Filed: Nov. 21, 1997

[51] Int. Cl.[6] ..... B65H 20/00; G03D 3/08

[52] U.S. Cl. ..... 226/181; 226/188; 396/612

[58] Field of Search ..... 226/181, 188; 242/615.4; 396/620, 612, 617, 622, 624; 100/917

[56] References Cited

U.S. PATENT DOCUMENTS

| | | | |
|---|---|---|---|
| 3,428,308 | 2/1969 | Bernard | 226/188 X |
| 3,556,000 | 1/1971 | Goodwin et al. | 100/917 X |
| 3,787,229 | 1/1974 | Rudness | 242/615.4 X |
| 4,062,484 | 12/1977 | Rausch et al. | 242/615.4 X |
| 4,290,353 | 9/1981 | Pav et al. | 100/162 B |
| 4,893,151 | 1/1990 | Yamazaki et al. . | |
| 5,232,141 | 8/1993 | Mittmeyer et al. . | |
| 5,392,702 | 2/1995 | Suzuki | 100/917 X |
| 5,426,535 | 6/1995 | Bigelow et al. . | |
| 5,473,418 | 12/1995 | Kazakos et al. . | |
| 5,782,177 | 7/1998 | Rindfleisch | 100/917 X |
| 5,794,091 | 8/1998 | Verlinden et al. | 396/612 |

*Primary Examiner*—Michael Mansen
*Attorney, Agent, or Firm*—Clyde E. Bailey, Sr.

[57] ABSTRACT

A method and apparatus for conveying a web utilizes magnetically coupled first and second rotatable elements. Rotation of one of the rotatable elements causes the simultaneous synchronous rotation of the other rotatable element. Both first and second rotatable elements include a magnetic core, a bonding layer at least partially surrounding the magnetic core, and a wear and abrasion resistant layer surrounding the bonding layer.

15 Claims, 4 Drawing Sheets

APPARATUS AND METHOD FOR CONVEYING A WEB

FIELD OF THE INVENTION

The invention relates to web conveyance, more particularly, the invention concerns a web conveyance apparatus and method that utilizes magnetic coupled, wear and abrasion resistant roller assemblages for conveying photosensitive web of indeterminate length in chemically corrosive environments.

BACKGROUND OF THE INVENTION

In the production of web materials, particularly photosensitive film web, devices that employ mechanically coupled rollers are widely used to convey the web material of indeterminate length between a variety of processing stations. More particularly, such apparatus will normally guide and move the web through a processing sequence involving developer, fixer, washing, and drying bathes stations which tend to expose the conveyance rollers of the apparatus to corrosive materials. With mechanically coupled driven rollers of the type presently used in web conveyance equipment, sensitive mechanical gears that synchronize the rotation of the rollers and some sort of drive means, typically a motor, coupled to the rollers for producing the desired rotation may be interrupted if exposed to harmful and deleterious materials.

Hence, it is well known that one major shortcoming of conventional mechanically coupled rollers is that the excessive exposure of the mechanical elements to various corrosive materials will invariably result in degraded mechanical performance. As a consequence, the equipment, and therefore production, must be frequently interrupted for maintenance and parts replacement.

Moreover, during the processing of photosensitive web, experience indicates that the web will invariably tend to show signs of objectionable wear and abrasion as the performance of conventional mechanically coupled conveyance rollers degrade during extensive and continuous exposure to corrosive materials. Hence, degraded rollers and associated web conveyance elements tend to have an adverse effect on the quality of the costly photosensitive web product.

Another well recognized problem associated with conventional web conveyance equipment is that such equipment does not easily accommodate photosensitive film webs having a variety of thickness. In order to accommodate the processing of such film webs (each having a different thickness) enormous downtime and production cost sacrifices are realized so that required adjustments to a transfer nip separating the mechanically coupled rollers can be made. Thus, photosensitive film web processing equipment that utilizes conventional mechanically coupled rollers as a means of conveying the film web through various processing stations require costly and time consuming maintenance and adjustment.

Therefore, a need persists for an apparatus and method of conveying photosensitive web materials in corrosive environments without the concerns that the equipment will require excessive and costly maintenance as well as will impart harmful defects to the film web. Moreover, there exists a need for such apparatus and method that easily accommodates adjustments for processing webs of different thickness.

SUMMARY OF THE INVENTION

It is, therefore, one object of the invention to provide an apparatus that can convey a film web in a corrosive environment without undergoing frequent maintenance and adjustments.

Another object of the invention is to provide an apparatus that employs magnetically coupled rollers capable of conveying photosensitive film web in a corrosive environment.

It is another object of the invention to provide magnetically coupled rollers that are wear and abrasion resistant.

It is a feature of the invention that an apparatus for conveying web incorporates a pair of conveyance rollers each of which includes a corrosion resistant layer and a wear and abrasion resistant layer surrounding a magnetic core, he magnetic core providing means for magnetically coupling the pair of rollers.

To solve one or more of the problems above, there is provided, in one aspect of the invention, a web conveyance apparatus comprising magnetically coupled first and second rotatable elements or rollers. First rotatable element has a first magnetic core and a first bonding layer at least partially surrounding and bonded to the first magnetic core. A first layer comprising a corrosion resistant material at least partially surrounds and is bonded to the first bonding layer. Also, a second bonding layer at least partially surrounds and is bonded to the first layer. At least partially surrounding and bonded to the second bonding layer is a second layer comprising a wear and abrasion resistant material.

Similarly, second rotatable element or roller having a second magnetic core for magnetically coupling with the first magnetic core of the first rotatable element includes a third bonding layer that at least partially surrounds and is bonded to the second magnetic core. A third layer comprising a corrosion resistant material at least partially surrounds and is bonded to the third bonding layer. Also, a fourth bonding layer at least partially surrounds and is bonded to the third layer. Over the fourth bonding layer is a fourth layer comprising a wear and abrasion resistant material that at least partially surrounds and is bonded to the core via the fourth bonding layer.

Further, a frame is provided for supporting the first rotatable element in a magnetic coupled relations with the second rotatable element. The first and second elements supported in the frame have a substantially uniform nip width therebetween for conveying a contacting web therethrough.

Moreover, means is provided for rotating one of the first and second rotatable elements. Rotation of either one of the first and second rotatable elements causes rotation of the corresponding magnetic core in the rotated first or second rotatable element. Because the rollers are magnetically coupled via the respective magnetic cores, the other roller will simultaneously and synchronously rotate.

In another aspect of the invention, a method of conveying a web comprises the steps of providing a magnetically coupled roller assemblage having a first and second roller arranged in a frame for receiving and then conveying the web therethrough and providing means for rotating either of the first and second rollers. The means for rotating is activated so that one of the first and second rotatable elements will rotate thereby causing the other rotatable element to simultaneously and synchronously rotate.

It is, therefore, an advantageous effect of the present invention that the apparatus of the invention can convey a web, such as photosensitive film web, in a corrosive environment without degradation of the conveyance elements. An additional advantage of the present invention is that the conveyance elements can be easily adjusted to accommodate webs of different thicknesses.

BRIEF DESCRIPTION OF THE DRAWINGS

The above mentioned and other objects, features and advantages of the invention and the manner of attaining them will become more apparent and the invention itself will be better understood by reference to the following description of an embodiment of the invention taken in conjunction with the accompanying drawings, wherein.

DETAILED DESCRIPTION OF THE INVENTION

Figure 1A:
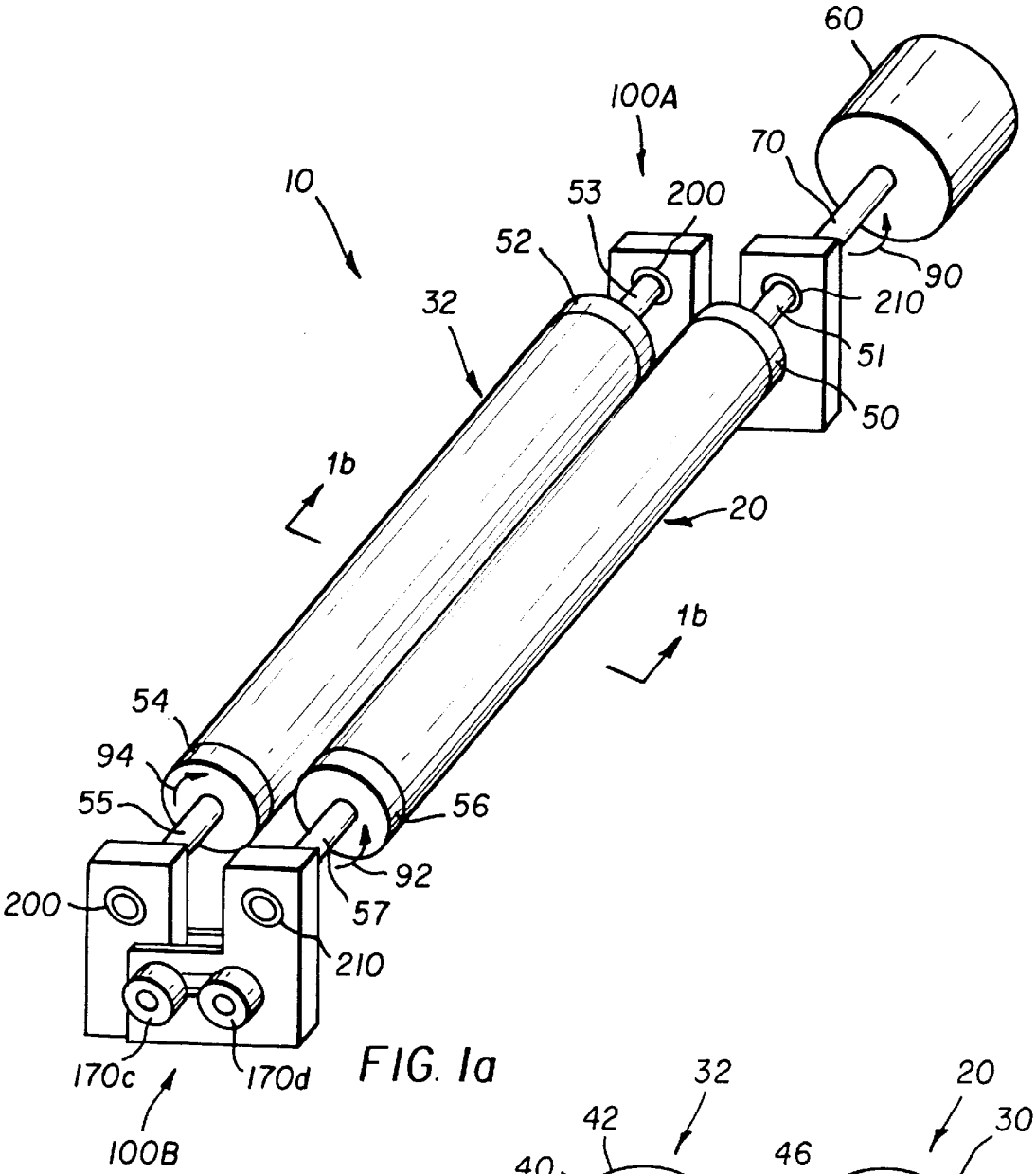
FIG. 1*a* is a perspective view of the web conveyance apparatus with motor drive.
Figure 5:
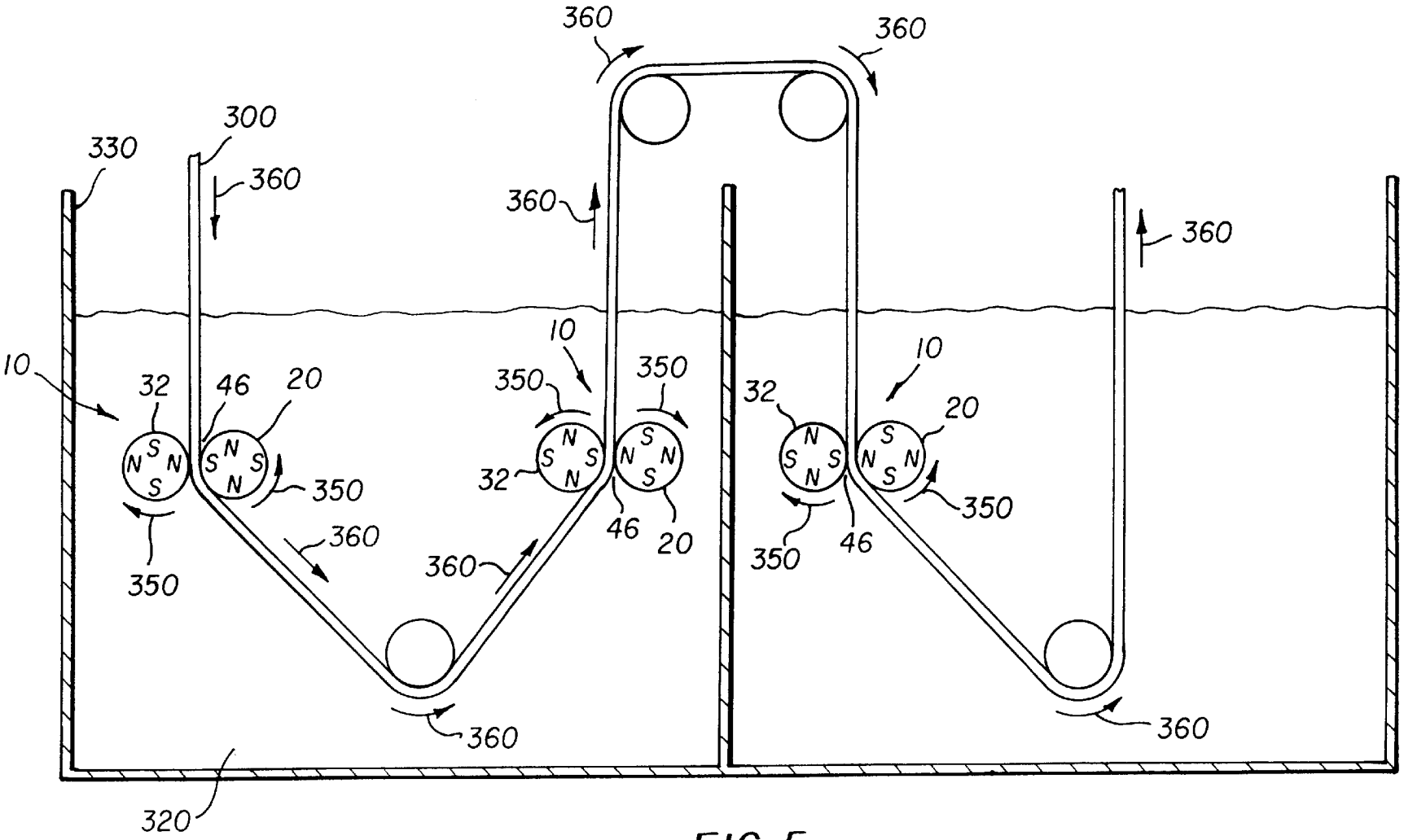

Turning now to the drawings, and in particular to FIGS. 1*a* and 5, the apparatus 10 according to the principles of the invention is illustrated. As shown in FIG. 1*a*, apparatus 10, broadly defined, includes a frame 100*a* and first and second rotatable elements, alternately referred to as first and second rollers 20, 32, mounted for rotation in the frame 100*a*. First and second rollers 20, 32 are similarly constructed as will be made evident below. The frame 100*a* provides support for first roller 20 which is mounted for magnetically coupling with the second roller 32, as fully described below. By precisely positioning rollers 20, 32 in the frame 100*a*, a substantially uniform nip width is formed between the mounted first and second rollers 20, 32 through which a contacting web can be conveyed. According to FIG. 5, rollers 20, 32 are arranged for conveying a web of indeterminate length through a series of web processing steps, such as fixing, washing, etc., which exposes the roller elements to corrosive materials.

Figure 1B:
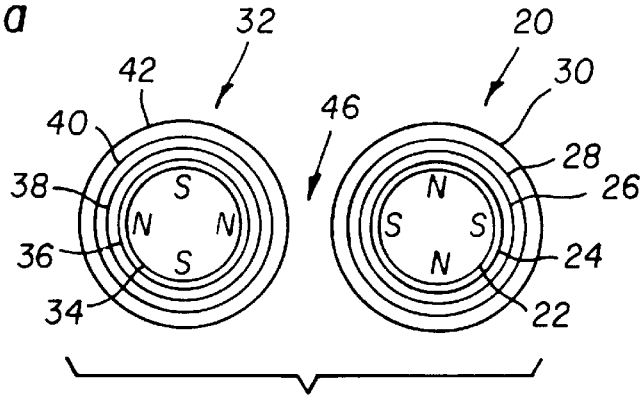
FIG. 1*b* is a cross-sectional view of the magnetic rollers taken along line 1*b*—1*b* in FIG. 1*a;*

Referring to FIG. 1*b*, the first and second rollers 20, 32 are shown in a cross-sectional view taken along line 1*b*—1*b* of FIG. 1*a*. As shown, first and second rollers 20, 32 are spaced slightly apart in the frame 100*a* forming nip 46 between them so as to accommodate a web of predetermined thickness. The first and second rollers 20, 32 comprise first and second magnetic cores 22, 34, respectively. The respective first and second magnetic cores 22, 34 are preferably made from a non rare-earth permanent magnet material such as aluminum-nickel-cobalt, barium-ferrite, copper-nickel-iron alloy, iron-cobalt-molybdenum alloy. Most preferred of the non rare-earth materials is aluminum-nickel-cobalt. The respective first and second magnetic cores 22, 34 may also be made of a rare-earth material such as neodymium-iron-born, or samarium-cobalt. In this instance, the most preferred material is neodymium-iron-boron manufactured by Magnaquench, Inc., of Indiana.

Referring to FIG. 1*b*, it is important to our invention that respective first and second magnetic cores 22, 34 are polarized with a plurality of radially disposed surface poles of alternating polarity around their circumferences.

Referring again to FIG. 1*b*, the first roller 20 further comprises first and second layers 26, 30, respectively which surround the first magnetic core 22. The first and second layers 26, 30, respectively are preferably coated onto the first magnetic core 22 using the techniques described below. According to our preferred embodiment, a first bonding layer 24 is coated onto the first magnetic core 22. First bonding layer 24 is preferably comprised of copper or copper based alloys, chromium, gold, silver and combinations thereof. Most preferred is copper and its alloys. Skilled artisans will appreciate that first bonding layer 24 may be applied to first magnetic core 22 by using any of several conventional techniques. We, however, prefer depositing the first bonding layer 24 onto first magnetic core 22 using physical vapor deposition (PVD), chemical vapor deposition (CVD), or some electroless or electrolytic deposition process, each producing substantially the same result. Preferably, we deposit first bonding layer 24 onto first magnetic core 22 using an electrolytic deposition process. In the preferred embodiment, first bonding layer 24 has a thickness in the range of about 50 to 200 Angstroms, preferably 100 Angstroms.

Referring once again to FIG. 1*b*, after the first bonding layer 24 is bonded to first magnetic core 22, a first layer 26 comprising a corrosion resistant material, is coated onto the first bonding layer 24. First layer 26 comprises preferably a coating of electroplated nickel or electroless nickel. The preferred method for depositing the first layer 26 of corrosion resistant material onto first bonding layer 24 is electroless plating. The first bonding layer 24 functions to enhance the adhesion of the first layer 26 of corrosion resistant material to the core 22. Preferably, first layer 26 has a thickness between 0.1 mil and 1 mil, most preferred being 0.5 mil.

According to FIG. 1*b*, a second bonding layer 28 is coated onto first layer 26. The second bonding layer comprises alloys of nickel-aluminum, nickel-chromium, cobalt-chromium-aluminum or combinations thereof. While numerous techniques may be used to deposit the second bonding layer 28, we prefer using a PVD or a plasma spraying. Preferably, the second bonding layer 28 has a thickness in the range of about 1,000 to 10,000 Angstroms, most preferred being 5,000 Angstroms.

Still referring to FIG. 1*b*, a second layer 30 comprising a wear and abrasion resistant material, is coated onto the second bonding layer 28. The second bonding layer 28 enhances the adhesion and minimizes the porosity of the second layer 30 by sealing pores (not shown) in the second layer 30. The preferred method for coating the second layer 30 onto the second bonding layer 28 is by dipping the roller 20 in solutions of polyurethane or acrylic. Alternatively, the second layer 30 may be spin or dip coated onto the second bonding layer 28 of first roller 20 in a solution of sol-gel comprising silicon dioxide or alumina. Yet another acceptable technique for coating the second layer 30 onto the second bonding layer 28 is thermal or plasma spraying with a wear and abrasion resistant material such as chromium oxide, zirconium oxide, aluminum oxide, or composites of zirconia-alumina, or a combination thereof.

Referring again to FIG. 1*b*, the second roller 32 further comprises third and fourth layers 38, 42, respectively which surround the second magnetic core 34. The third and fourth layers 38, 42 comprise the same materials as the first and second layers 26, 30, respectively, which surround the first magnetic core 22 as described above. Moreover, the third and fourth layers 38, 42 are coated onto the second roller 32 using the same techniques and specifications as described above for coating the first and second layers 26 and 30, respectively, onto the first magnetic core 22. Specifically, third and fourth bonding layers 36, 40, respectively, comprising the same materials as first and second bonding layers 24, 28, respectively, enhance the adhesion of third and fourth layers 38, 42, respectively. The third and fourth bonding layers 36, 40 are coated onto the second roller 32 using the same techniques and specifications as described above for coating the first and second bonding layers 24, 28, respectively, as described above.

Figure 2:
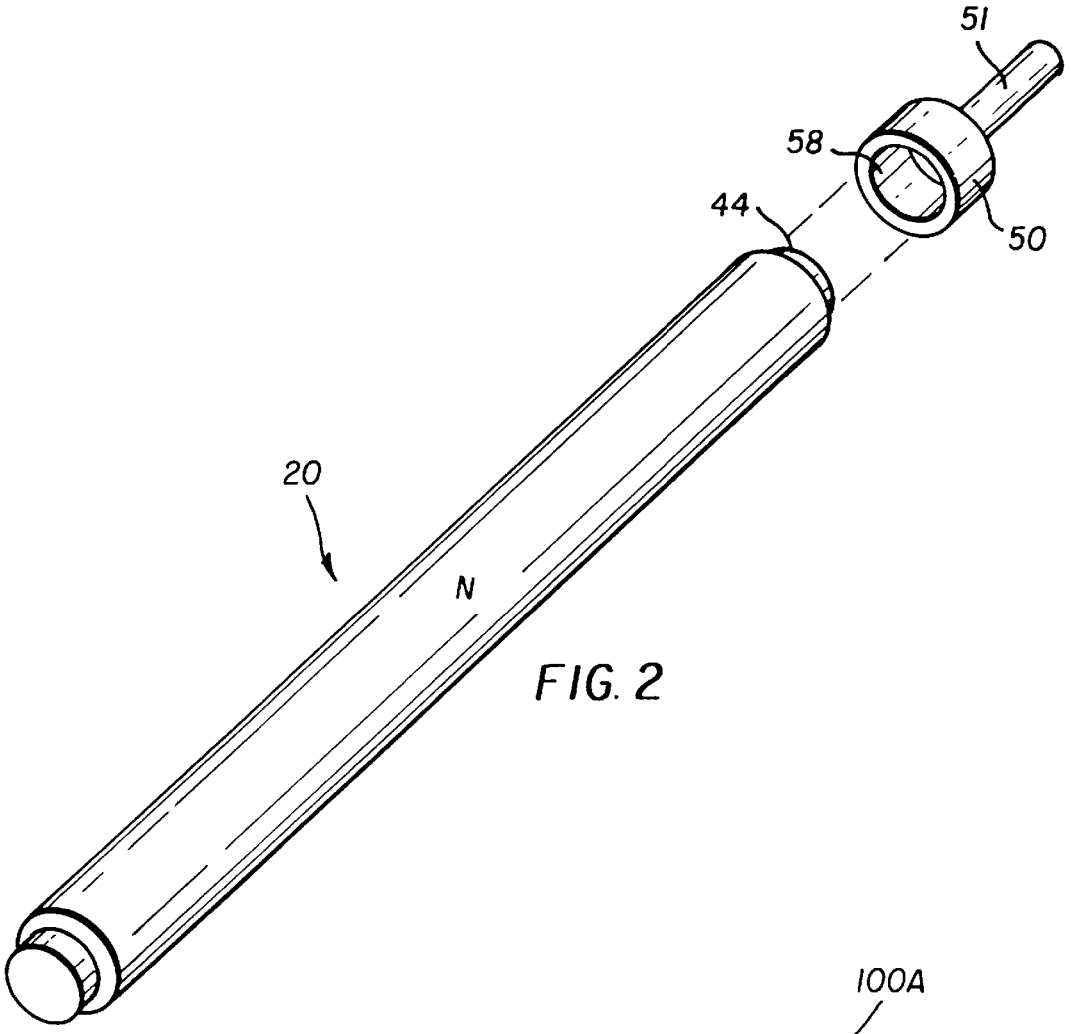
FIG. 2 is a exploded view of the a magnetic roller and end shaft member.

Referring to FIG. 2, a perspective is shown of the first roller 20 and 30 end support member 50. The end support member 50 has a cavity 58 for receiving the tapered end 44 of the first roller 20. The end support member 50 is fixedly attached to the end of the first roller 20 by shrink fitting or alternatively by press fitting. The other end support members 52, 54, 56, which are identical in to end support member 50, are fixedly attached in a similar fashion to the respective ends of the first and second rollers 20, 32, as shown in FIG. 1*a*.

Figure 3:
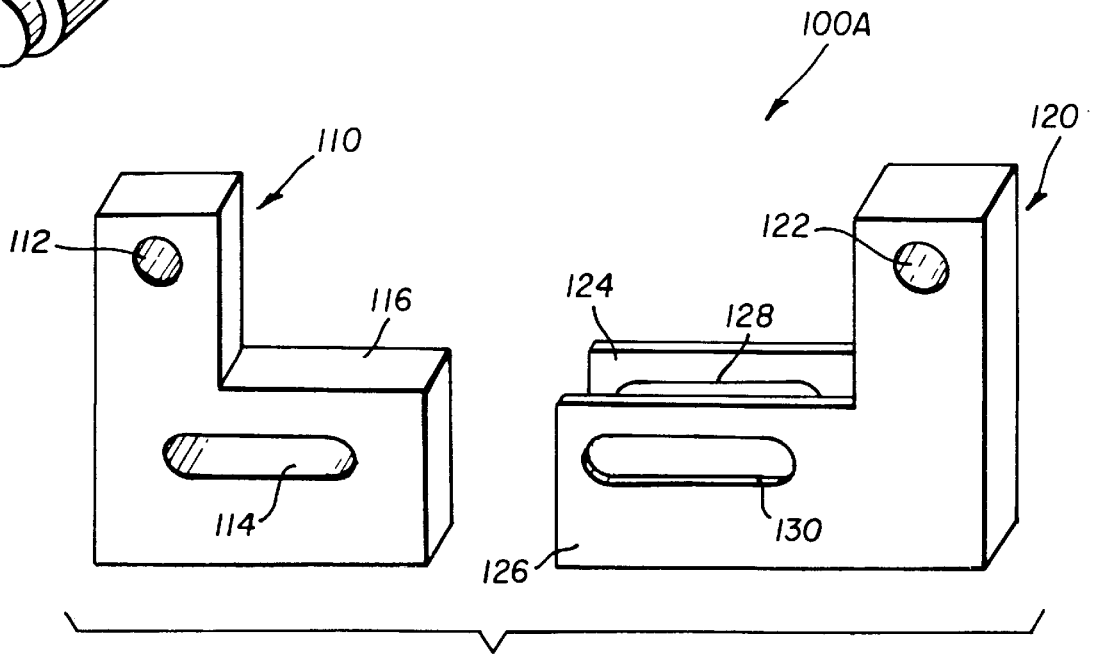
FIG. 3 is a perspective view of the frame.

Referring to FIG. 3, an exploded view of frame 100*a* is shown. The frame 100*a* comprises a bearing bracket component 110 with a through-hole 112, insert receiving hole 114, and wall 116. The frame 100*a* further comprises a bearing bracket component 120 with a through-hole 122, and walls 124, 126 with insert receiving holes 128, 130 respectively.

Figure 4:
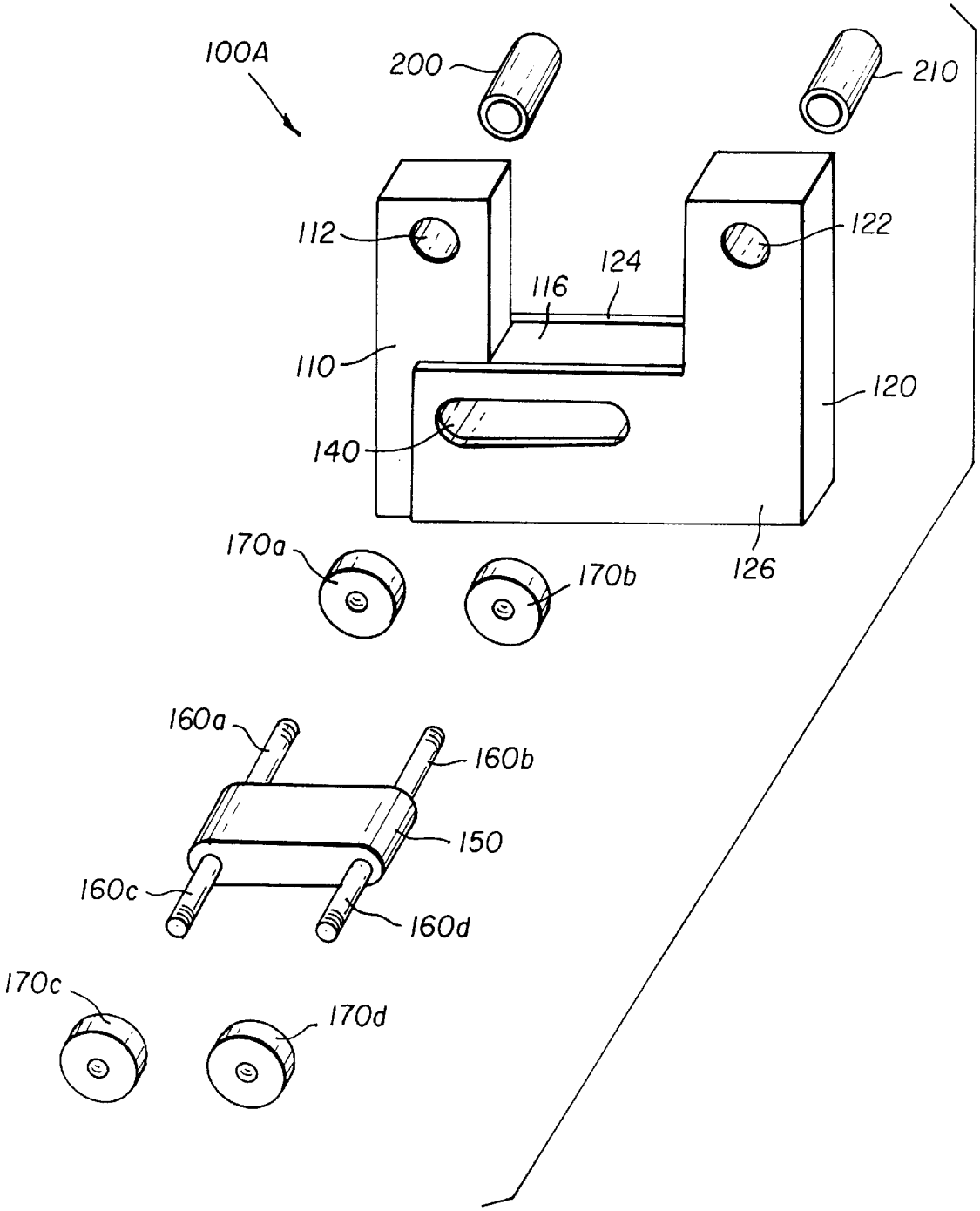
FIG. 4 is an exploded view of the frame assembly with sleeve bearings and threaded insert; and, FIG. 5 is a schematic cross-sectional view of a web conveyance apparatus of the invention.

Referring to FIG. 4, a perspective is shown of a partially assembled frame 100*a*. Specifically, bearing bracket component 110 abuts bearing bracket component 120 such that wall 116 of bearing bracket component 110 is between walls 124, 126 of bearing bracket component 120 with insert receiving hole 114 aligned with insert receiving holes 128, 130 forming insert receiving hole 140. The horizontal spacing between through-hole 112 of bearing bracket component 110 and through-hole 122 of bearing bracket component 120 is determined by the width of insert 150 which is inserted into the insert hole 140. Thus insert members of different widths can be used to vary the horizontal spacing between through-holes 112, 122. The insert member 150 with threaded portions 160*a*, 160*b*, 160*c*, 160*d* is fixedly attached to assembled frame 100*a* once it is inserted into insert receiving hole 140 by screwing bolts 170*a*, 170*b*, 170*c*, 170*d* onto threaded portions 160*a*, 160*b*, 160*c*, 160*d*, respectively. Bearing sleeves 200 and 210 are shrunk fit into through-holes 112, 122, respectively. Referring again to FIG. 1*a*, the transport roller assembly is shown with identical frames 100*a*, 100*b* assembled and adjusted to provide a specific separation between first and second rollers 20, 32.

Further, first and second rotatable elements or rollers each have end support members 50, 52, 54, 56 which are shrunk fit onto the ends of the first and second rollers 20, 32 as shown. The shaft portion 51 of end support member 50 passes through sleeve bearing 210 in frame 100*a* and is fixedly attached to rotor shaft 70 of motor 60. The shaft portions 53, 55, 57 of end support members 52, 54, 56, respectively, pass through the respective sleeve bearings in frames 100*a* and 100*b*. Thus the first and second rollers 20, 32, respectively, are free to rotate about their longitudinal axis. When motor 60 rotates it causes rotation of the first roller 20 which, in turn, causes synchronized rotation of the second roller 32 due to their mutual magnetic coupling (see rotation arrows 90, 92, 94). The end support members 50, 52, 54, 56 are made from AISI 316 stainless steel, wherein the end shaft portions 51, 53, 55, 57 are electroplated with Teflon impregnated nickel so as to reduce the coefficient of friction.

Referring to FIG. 5, a schematic cross-sectional view is shown of a web transport system utilizing the web conveyance apparatus 10 of the present invention. A web of material 300 is transported through a corrosive solution 320 container 330. The first and second rollers 20, 32 rotate as indicated by rotation arrows 350. The web 300 passes through the nip 46 between the first and second rollers 20, 32, and is moved via a frictional force as indicated by translation arrows 360.

The invention has thus been described in detail with the particular reference to certain preferred embodiments thereof, but it will be understood that variations and modifications can be effected within the spirit and scope of the invention.

What is claimed is:

1. Web conveyance apparatus, comprising:

a first rotatable element having a first magnetic core defining a first shaft; a first bonding layer at least partially surrounding and bonded to said first magnetic core; a first layer at least partially surrounding and bonded to said first bonding layer, said first layer comprising a corrosion resistant material; a second bonding layer at least partially surrounding and bonded to said first layer; a second layer at least partially surrounding and bonded to said second bonding layer, said second layer comprising a wear and abrasion resistant material; and, a second rotatable element having a second magnetic core defining a second shaft for magnetically coupling with said first magnetic core of said first rotatable element; said second rotatable element further having a third bonding layer at least partially surrounding and bonded to said second magnetic core; a third layer at least partially surrounding and bonded to said third bonding layer, said third layer comprising a corrosion resistant material; a fourth bonding layer at least partially surrounding and bonded to said third layer; a fourth layer at least partially surrounding and bonded to said fourth bonding layer, said fourth layer comprising a wear and abrasion resistant material;

a frame for supporting said first rotatable element in a magnetic coupled relations with said second rotatable element, said first and second elements supported in said frame having a substantially uniform nip width therebetween for conveying a contacting web therethrough; and, means for rotating one of said first and second rotatable elements, wherein rotation of either one of said first and second rotatable elements causes rotation of one of said first and second magnetic cores corresponding to said either one of said first and second rotatable elements in said magnetically coupled relations, which rotation simultaneously causes synchronous rotation of the other of said first and second rotatable elements.

2. The apparatus recited in claim 1 wherein said first magnetic core is made from a permanent magnet material, said permanent magnet material being polarized with a plurality of radially disposed surface poles of alternating polarity around its circumference.

3. The apparatus system recited in claim 2 wherein said permanent magnet material is a rare-earth magnetic material selected from the group consisting of:

(a) neodymium-iron-boron;

(b) samarium-cobalt.

4. The apparatus recited in claim 2 wherein said permanent magnet material is a non rare-earth magnetic material selected from the group consisting of:

(a) aluminum-nickel-cobalt alloys;

(b) barium-ferrite;

(c) copper-nickel-iron alloy;

(d) iron-cobalt-molybdenum alloy.

5. The apparatus recited in claim 1, wherein said first bonding layer is selected from the group consisting of: (a) copper; (b) copper based alloys; (c) chromium; (d) gold; (e) silver.

6. The apparatus recited in claim 1, wherein said second bonding layer is selected from the group consisting of: (a) alloys of nickel-aluminum; (b) alloys of nickel-chromium; (c) alloys of cobalt-chromium-aluminum.

7. The apparatus recited in claims 1 and 2, wherein said wear and abrasion resistant materials is selected from the group consisting of: (a) polyurethane; (b) acrylic; (c) silicon dioxide; (d) alumina; (e) chromium oxide; (f) zirconium oxide; (g) composites of zirconia-alumina.

8. The apparatus recited in claim 1 wherein said second magnetic core is made from a permanent magnet material, said permanent magnet material being polarized with a plurality of radially disposed surface poles of alternating polarity around its circumference.

9. The apparatus recited in claim 8 wherein said permanent magnet material is a rare-earth magnetic material selected from the group consisting of:

(a) neodymium-iron-boron;

(b) samarium-cobalt.

10. The apparatus recited in claim 8 wherein said permanent magnet material is a non rare-earth magnetic material selected from the group consisting of:

(a) aluminum-nickel-cobalt alloys;

(b) barium-ferrite;

(c) copper-nickel-iron alloy;

(d) iron-cobalt-molybdenum alloy.

11. The apparatus recited in claim 1, wherein said third bonding layer is selected from the group consisting of: (a) copper; (b) copper based alloys; (c) chromium; (d) gold; (e) silver.

12. The apparatus recited in claim 1, wherein said fourth bonding layer is selected from the group consisting of: (a) alloys of nickel-aluminum; (b) alloys of nickel-chromium; (c) alloys of cobalt-chromium-aluminum.

13. The apparatus recited in claim 1, wherein said corrosion resistant material is electroplated nickel or electroless nickel.

14. The apparatus recited in claim 1, wherein said wear and abrasion resistant materials is selected from the group consisting of: (a) polyurethane; (b) acrylic; (c) silicon dioxide; (d) alumina; (e) chromium oxide; (f) zirconium oxide; (g) composites of zirconia-alumina.

15. A method of conveying a web, comprising:

providing a magnetically coupled roller assemblage having a first and second roller arranged in a frame for receiving and then conveying the web therethrough, wherein said first and second rollers each has a magnetic core and at least partially surrounding the magnetic core a corrosion resistant layer and an abrasion resistant layer bonded thereto;

providing means for rotating either of said first and second rollers in said magnetically coupled relations;

activating said means for rotating so that said either of said first and second rotatable elements will rotate thereby causing the other of said first and second rotatable elements to simultaneously synchronously rotate.

* * * * *